US008926364B2

(12) United States Patent
Saitoh

(10) Patent No.: US 8,926,364 B2
(45) Date of Patent: Jan. 6, 2015

(54) HOLDER LOCK STRUCTURE

(75) Inventor: Masayuki Saitoh, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/884,276

(22) PCT Filed: Nov. 7, 2011

(86) PCT No.: PCT/JP2011/006206

§ 371 (c)(1),
(2), (4) Date: May 9, 2013

(87) PCT Pub. No.: WO2012/063457

PCT Pub. Date: May 18, 2012

(65) Prior Publication Data

US 2013/0230999 A1 Sep. 5, 2013

(30) Foreign Application Priority Data

Nov. 12, 2010 (JP) ..... 2010-253720

(51) Int. Cl.

| | |
|---|---|
| ***H01R 13/422*** | (2006.01) |
| ***H01R 13/639*** | (2006.01) |
| ***H01R 13/436*** | (2006.01) |
| ***H01R 13/506*** | (2006.01) |

(52) U.S. Cl.

CPC ..... *H01R 13/639* (2013.01); *H01R 13/4364* (2013.01); *H01R 13/506* (2013.01)

USPC ..... 439/595; 439/752

(58) Field of Classification Search

CPC ..... H01R 13/4364; H01R 13/4223; H01R 13/04223; H01R 13/022; H01R 13/094

USPC ..... 439/752, 595, 340

See application file for complete search history.

(56) References Cited

U.S. PATENT DOCUMENTS 5,256,083 A * 10/1993 Yamamoto ..... 439/752
5,730,626 A * 3/1998 Tomita et al. ..... 439/595

(Continued)

FOREIGN PATENT DOCUMENTS

EP 0877447 A2 11/1998
EP 1162704 A1 12/2001

(Continued)

OTHER PUBLICATIONS

Japanese official action issued on Sep. 16, 2014 in the counterpart Japan patent application. (Partial English translation also submitted.).

*Primary Examiner* — Briggitte R Hammond

(74) *Attorney, Agent, or Firm* — Marvin A. Motsenbocker; Mots Law, PLLC

(57) ABSTRACT

A holder locking structure includes: a connector housing and a front holder. The connector housing includes: a fitting hood to which another connector is inserted and fit; a terminal accommodation accommodating a terminal fitting; a rib which is protruded into the fitting hood and is configured to prevent terminal connection fault of the terminal fitting; and a first locking portion configured to lock the front holder. The front holder is inserted in the fitting hood of the connector housing and is locked to the connector housing to prevent removal of the terminal fitting. The front holder is provided with a rib insertion hole to which the rib is inserted and a jig insertion hole into which a jig can be inserted to unlock the front holder from the connector housing. The rib insertion hole and the jig insertion hole are continuously provided.

3 Claims, 9 Drawing Sheets

(56) References Cited

U.S. PATENT DOCUMENTS

| | | | | |
|---|---|---|---|---|
| 5,813,882 | A * | 9/1998 | Saito et al. | 439/595 |
| 5,944,558 | A * | 8/1999 | Iwahori | 439/595 |
| 6,764,335 | B2 * | 7/2004 | Ichio | 439/595 |
| 7,661,999 | B2 * | 2/2010 | Horiuchi et al. | 439/752 |
| 7,682,191 | B2 * | 3/2010 | Iwahori et al. | 439/595 |
| 2002/0016106 | A1 | 2/2002 | Okayasu et al. | |
| 2002/0111071 | A1 * | 8/2002 | Pade | 439/595 |
| 2002/0127914 | A1 * | 9/2002 | Yamamoto | 439/595 |
| 2004/0076466 | A1 | 4/2004 | Nakamura | |
| 2004/0087209 | A1 * | 5/2004 | Nakamura | 439/595 |
| 2005/0090148 | A1 | 4/2005 | Sagawa et al. | |
| 2009/0042438 | A1 | 2/2009 | Iwahori et al. | |

FOREIGN PATENT DOCUMENTS

| | | | |
|---|---|---|---|
| EP | 1524730 | A1 | 4/2005 |
| JP | S63-193471 | A | 8/1988 |
| JP | H07-042016 | U | 7/1995 |
| JP | H09-161875 | A | 6/1997 |
| JP | H10-308249 | A | 11/1998 |
| JP | 2004-139758 | A | 5/2004 |
| JP | 2007-317372 | A | 12/2007 |

* cited by examiner

HOLDER LOCK STRUCTURE

TECHNICAL FIELD

The present invention relates to a holder lock structure for locking a front holder to a connector housing.

BACKGROUND ART

One of conventional examples of a holder lock structure for locking parts of a connector housing is described in PTL 1. In the holder lock structure of this conventional example, the connector housing is composed of an inner housing and an outer housing. The inner housing is locked to the outer housing, and a terminal fitting is inserted in the connector housing. The terminal fitting of the holder lock structure is connected to a terminal of another connector.

As illustrated in FIGS. 1 and 2, a holder lock structure 100 of the conventional example is substantially composed of a connector housing 111 separated into an outer housing 101 and an inner housing 105; and a terminal fitting 121 accommodated in the connector housing 111.

The outer housing 101 includes an accommodation portion 102, a lock receiving portion 103, and a taper portion 104. The accommodation portion 102 accommodates the inner housing 105 inside. The lock receiving portion 103 keeps the inner housing 105 retained. The taper portion 104 is pressed by a jig when the lock of the outer housing 101 and inner housing 105 is released.

The inner housing 105 includes a lock portion 106 and a terminal retainer portion 107. The lock portion 106 is locked to the lock receiving portion 103 of the outer housing 101. The terminal retainer portion 107 prevents the terminal fitting 121 from being removed.

The lock portion 106 of the inner housing 105 is locked to the lock receiving portion 103 of the outer housing 101, so that the inner housing 105 is held so as not to separate from the outer housing 101.

In order to release the lock of the outer and inner housings 101 and 105 for maintenance or the like, the jig is inserted into the connector housing 111 to press the taper portion 104. The lock portion 106 locked to the lock receiving portion 103 is then unlocked to release the lock of the outer and inner housings 101 and 105.

CITATION LIST

Patent Literature

[PTL 1]
US 2004/0076466 A1

SUMMARY OF INVENTION

However, in the holder lock structure 100 of the conventional example described above, in order to release the lock of the outer and inner housings 101 and 105, it is necessary to ensure a certain space to insert the unlocking jig in the connector housing 111. Accordingly, it is difficult to miniaturize the connector housing 111.

The present invention was made to solve the aforementioned problems, and an object of the present invention is to provide a holder lock structure capable of miniaturizing a connector housing.

In order to achieve the aforementioned object, a holder locking structure according to a first aspect of the present invention includes: a connector housing and a front holder.

The connector housing includes: a fitting hood to which another connector is inserted and fit; a terminal accommodation accommodating a terminal fitting; a rib which is protruded into the fitting hood and is configured to prevent terminal connection fault of the terminal fitting; and a first locking portion configured to lock the front holder. The front holder is inserted in the fitting hood of the connector housing and is locked to the connector housing to prevent removal of the terminal fitting. The front holder is provided with a rib insertion hole to which the rib is inserted and a jig insertion hole into which a jig can be inserted to unlock the front holder from the connector housing. The rib insertion hole and the jig insertion hole are continuously provided.

For the rib insertion hole and the jig insertion hole are continuously provided, it is unnecessary to separately provide a hole to insert the jig. There is no need to separately ensure space for the jig to be inserted into the connector housing, thus achieving miniaturization of the connector housing.

Preferably, the rib is provided so as to be continuous from an inner surface of the fitting hood. Moreover, preferably, the rib insertion hole and the jig insertion hole continuously provided for the front holder are opened toward the inner surface of the fitting hood.

For the rib insertion hole and the jig insertion hole continuously provided are opened to the inner surface of the fitting hood, there is no need to separately provide a hole to insert the jig.

Preferably, the connector housing includes a connector body provided with the terminal accommodation and the first locking portion, and the fitting hood is integrally formed with the connector body. Preferably, a contact portion of the terminal fitting accommodated in the terminal accommodation is protruded in the fitting hood. Preferably, the rib is integrally formed with the connector body and is protruded in the fitting hood to prevent terminal connection fault of the terminal fitting protruding in the fitting hood. Preferably, the front holder includes: a holder body in which a insertion hole to which the rib is inserted and the jig insertion hole are formed; a terminal retaining protrusion portion preventing the terminal fitting accommodated in the terminal accommodation of the connector housing from being removed; and a second locking portion locked to the first locking portion of the connector housing.

For the rib insertion hole and jig insertion hole are formed in the holder body of the front holder, there is no need to separately provide a hole to insert a jig, thus implementing miniaturization of the connector housing.

DESCRIPTION OF EMBODIMENTS

Hereinafter, a description is given of embodiments of the present invention with reference to the drawings. In the description of the embodiments of the present invention, the holder lock structure is configured to lock a front holder to a connector housing.

First Embodiment

Figure 1:
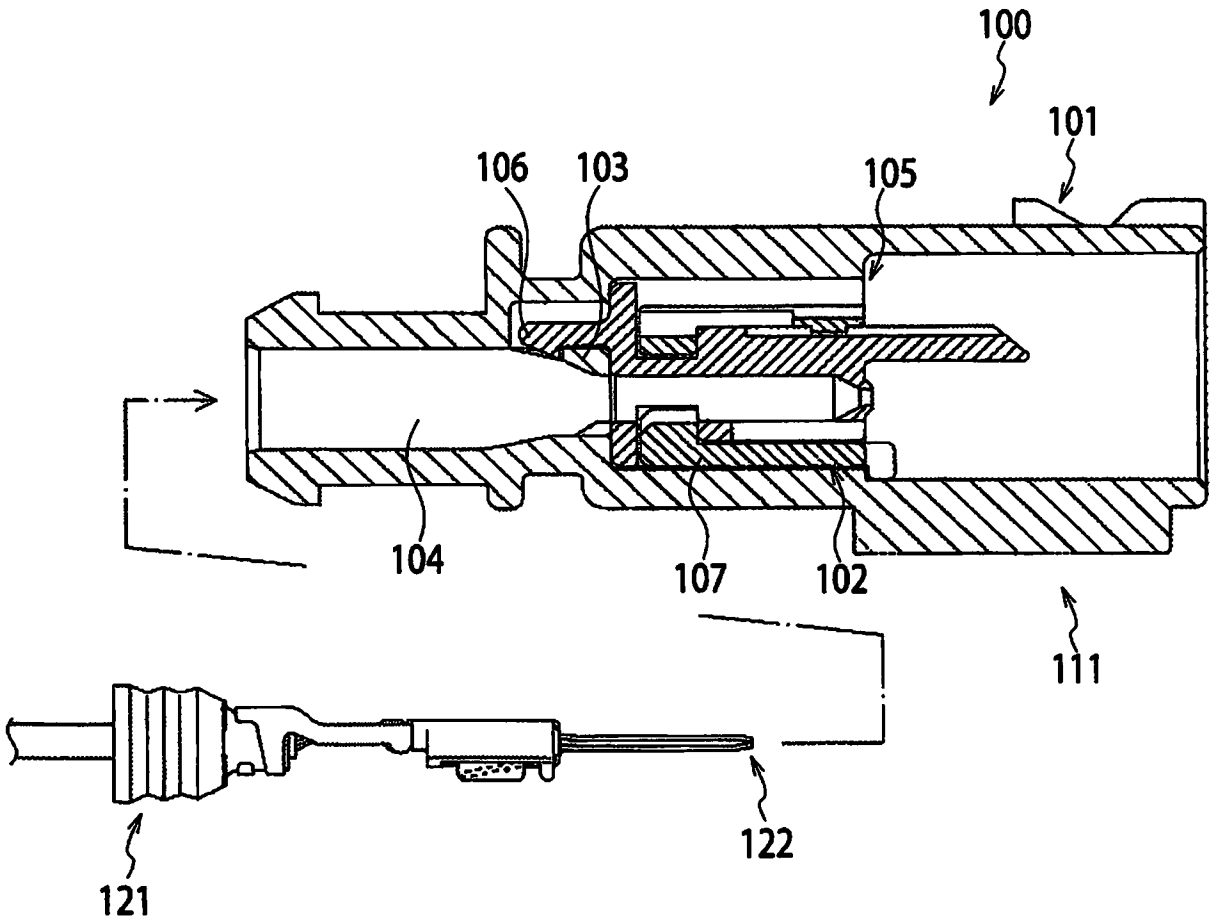
Fig. 1 PRIOR ART
FIG. 1 is a cross-sectional view of a holder lock structure of a conventional example.
Figure 2:
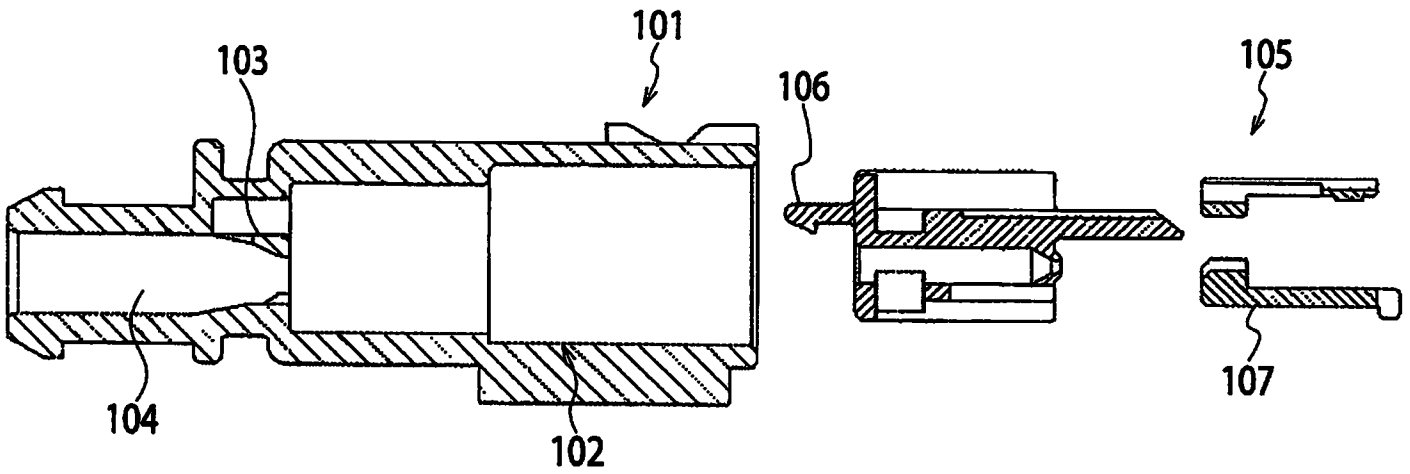
Fig. 2 PRIOR ART
FIG. 2 is a cross-sectional view of the holder lock structure of the conventional example.
Figure 3:
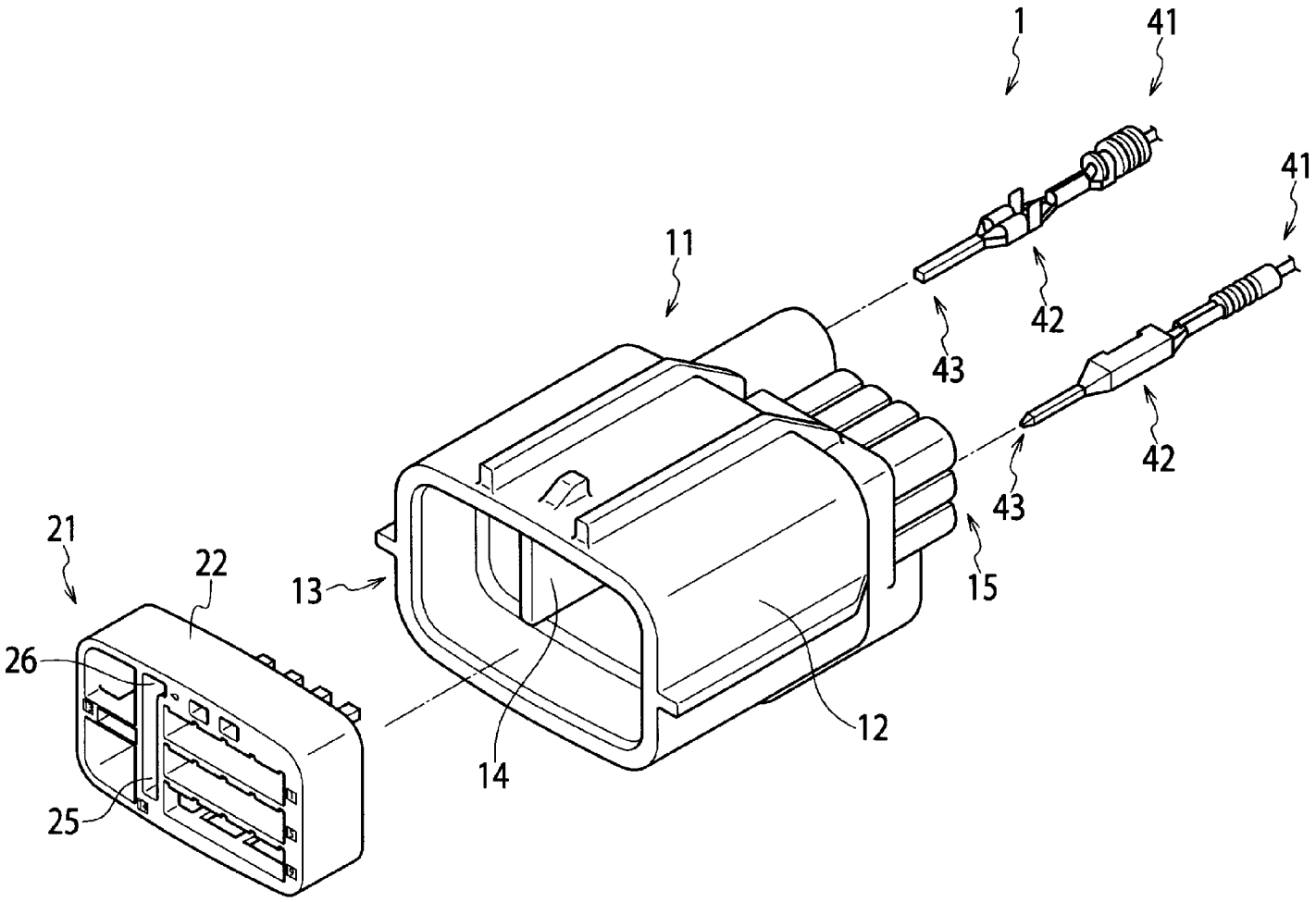
FIG. 3 is a perspective view of a holder lock structure according to a first embodiment of the present invention.
Figure 4:
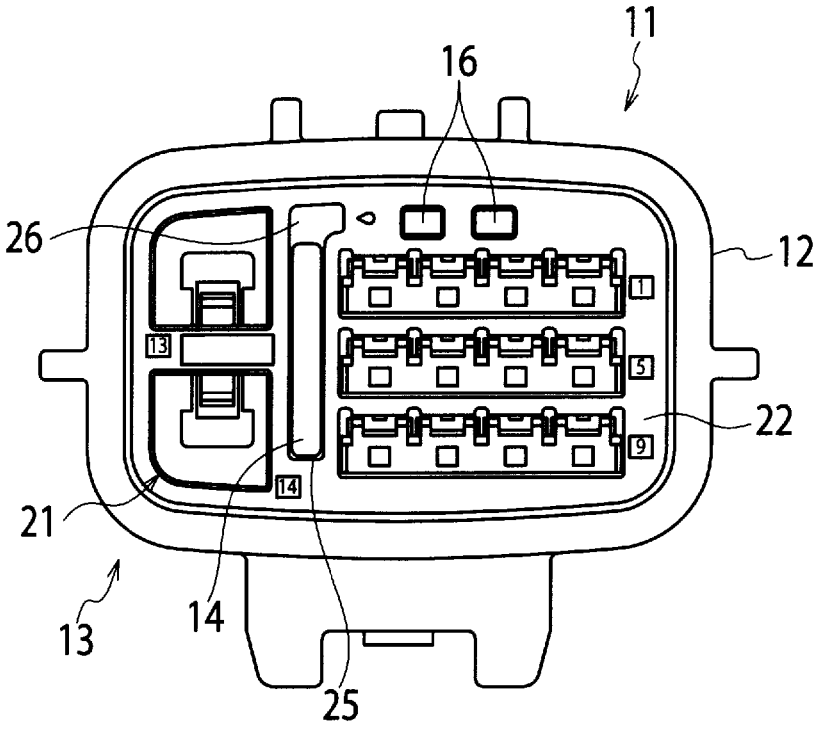
FIG. 4 is a front view of a connector housing of the holder lock structure according to the first embodiment of the present invention.
Figure 5:
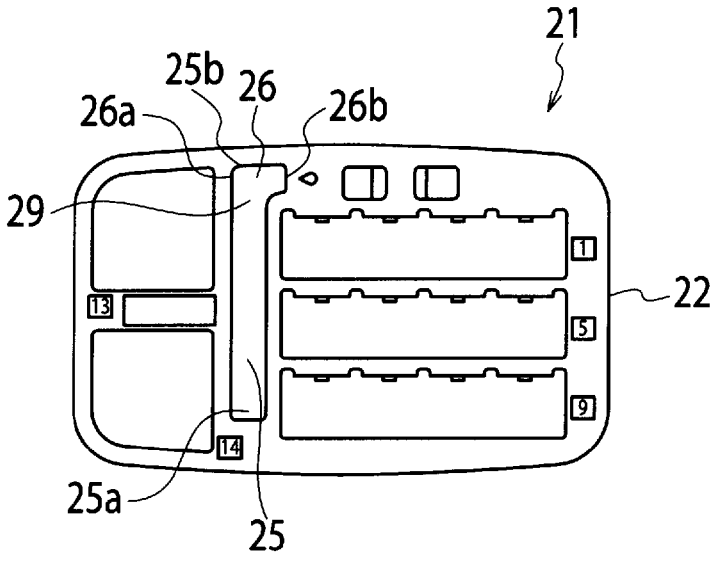
FIG. 5 is a front view of a front holder of the holder lock structure according to the first embodiment of the present invention.

First, a description is given of a holder lock structure according to a first embodiment of the present invention with reference to FIGS. 3 to 5. As illustrated in FIG. 3, the holder lock structure 1 according to the embodiment of the present invention substantially includes: a connector housing 11 made of synthetic resin; a front holder 21 which is made of synthetic resin and is locked to the connector housing 11; and female terminal fittings 41.

The connector housing 11 includes a connector body 12, a fitting hood 13, and a rib 14. In the connector body 12, the front holder 21 is locked. Into the fitting hood 13, another connector (a male terminal connector, not shown)) is inserted and fit. The rib 14 is formed integrally with the connector body 12 and is provided so as to protrude into the fitting hood 13. The rib 14 prevents terminal connection fault of the terminals. Herein, the terminal connection fault refers to a state where male and female terminals cannot be connected to each other because the terminals are bent.

The connector body 12 includes a terminal accommodation 15 and a first lock portion 16. The terminal accommodation 15 is formed integrally with the connector body 12. In the terminal accommodation 15, the plurality of terminal fittings 41 are accommodated so as to penetrate the same from an end at which the front holder 21 is locked to the other end opposite to the same. The first lock portion 16 locks the front holder 21 (see FIG. 4).

The front holder 21 includes a holder body 22, terminal retaining protrusion portions 23, and a second lock portion 24. The holder body 22 is inserted into the connector housing 11. The terminal retaining protrusion portions 23 prevent the terminal fittings 41 accommodated in the terminal accommodation 15 of the connector housing 11 from separating (see FIG. 8(*b*) described later). The second lock portion 24 is locked to the first lock portions 16 of the connector housing 11 (see FIG. 8(*b*) described later).

The holder body 22 is provided with a rib insertion hole 25 and a jig insertion hole 26. The rib 14 of the connector housing 11 is inserted into the rib insertion hole 25. A jig 51 is inserted into the jig insertion hole 26 to detach the front holder 21 from the connector holder 11. The jig insertion hole 26 is provided near the second lock portion 24 (see FIG. 8(*b*) described later).

The rib insertion hole 25 and the jig insertion hole 26 are continuously provided. The rib 14, which is to be inserted into the rib insertion hole 25, is provided continuously to an inner surface of the fitting hood 13 (a surface opposite to the side to which the front holder 21 is locked). The jig insertion hole 26 continuous to the rib insertion hole 25 is opened toward the inner surface side of the fitting hood 13 (the surface opposite to the side to which the front holder 21 is locked).

The rib insertion hole 25 is linearly extended from a lower end 25*a* (the lower side of the front holder 21) to an upper end 25*b* (the upper side of the front holder 21). A connecting portion 29 connecting the rib insertion hole 25 and the jig insertion hole 26 is located on a left end 26*a* side of the jig insertion hole 26. The right end 26*b* continuous to the left end 26*a* of the jig insertion hole 26 is provided on a straight line toward the center of the front holder 21 (see FIG. 5).

As described above, the rib insertion hole 25, to which the rib 14 is inserted, and the jig insertion hole 26, to which the jig 51 is inserted for removing the front holder 21 from the connector housing 11, are continuously provided. Moreover, the rib insertion hole 25, to which the rib 14 is inserted, and the jig insertion hole 26 continuous to the rib insertion hole 25 are opened toward the inner surface of the fitting hood 13. It is therefore unnecessary to provide another hole to insert the jig 51. Accordingly, there is no need to ensure space for providing a hole to insert the jig 51 in the connector housing 11. Such a configuration can provide the holder lock structure 1 capable of miniaturizing the connector housing 11.

The terminal retaining protrusion portions 23 (see FIG. 8(*b*) later described) are flexible. When the terminal fittings 41 are inserted, the terminal retaining protrusion portions 23 bend toward the rib insertion hole 25 (toward the lower side of the front holder 21). This prevents the terminal fittings 41 accommodated in the terminal accommodation 15 of the connector housing 11 from being removed from the connector housing 11.

Each of the terminal fitting 41 includes a contact portion 42 and a wire connecting portion (a contact portion of the terminal fitting) 43. The contact portion 42 protrudes into the fitting hood 13 when being accommodated in the terminal accommodation 15. The wire connecting portion 43 is electrically connected to a terminal of another connector (not shown).

Figure 6:
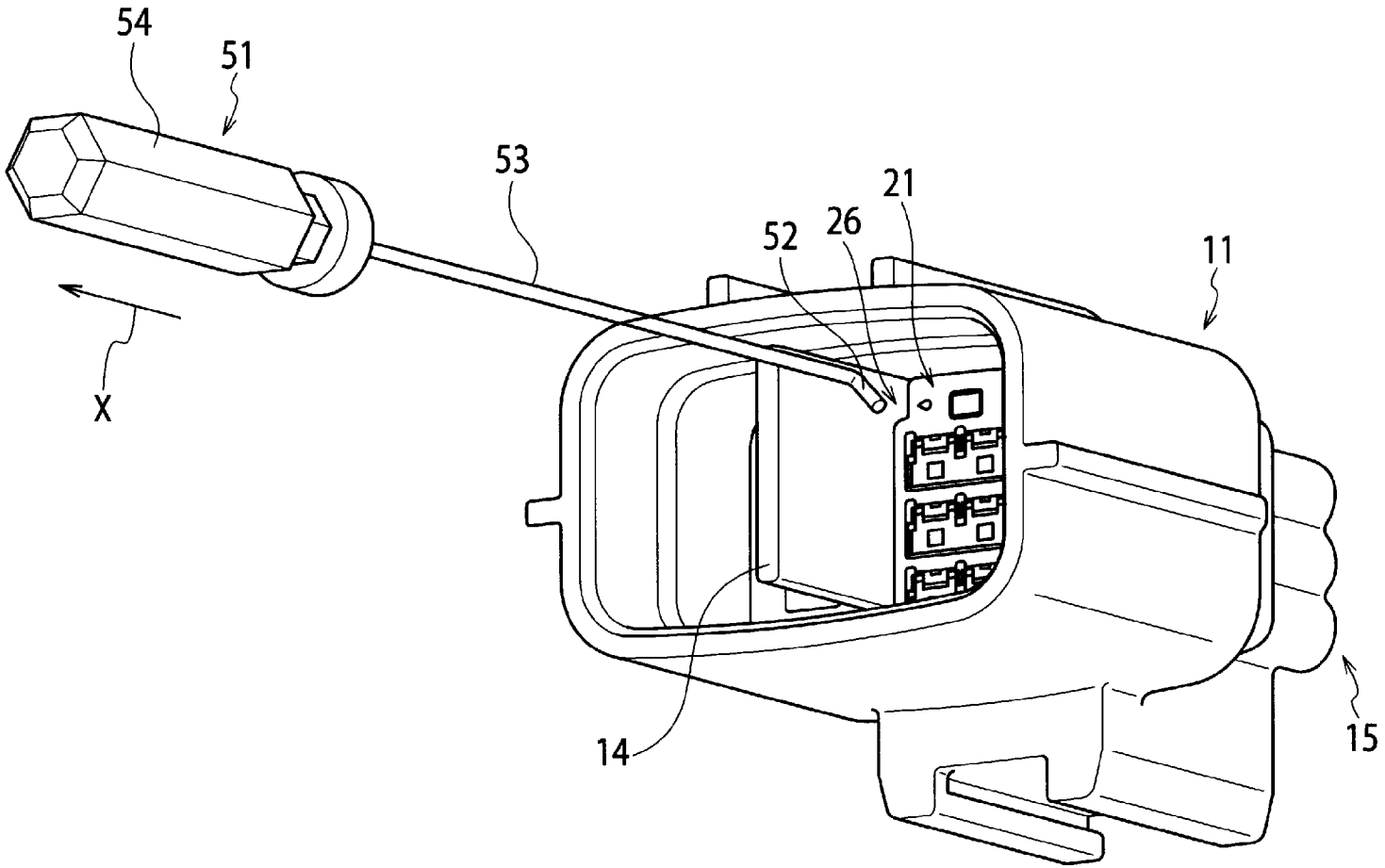
FIG. 6 is a perspective view illustrating a state where a jig is to be inserted into the connector housing and front holder of the holder lock structure according to the first embodiment of the present invention.
Figure 7:
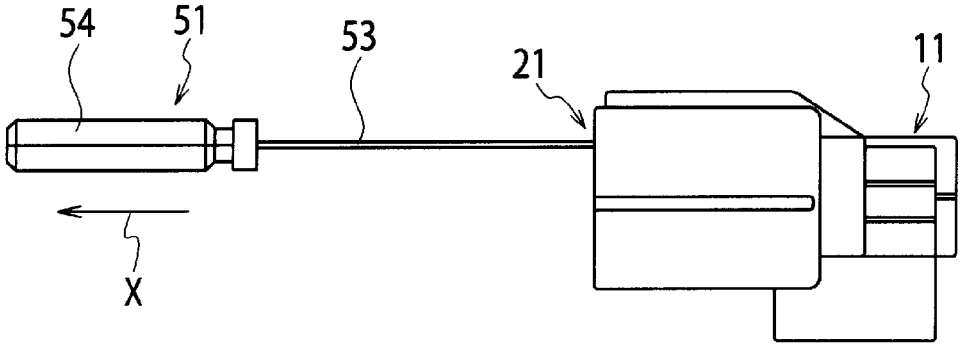
FIG. 7 is a side view illustrating a state where the jig is inserted in the connector housing and front holder of the holder lock structure according to the first embodiment of the present invention.
Figure 8:
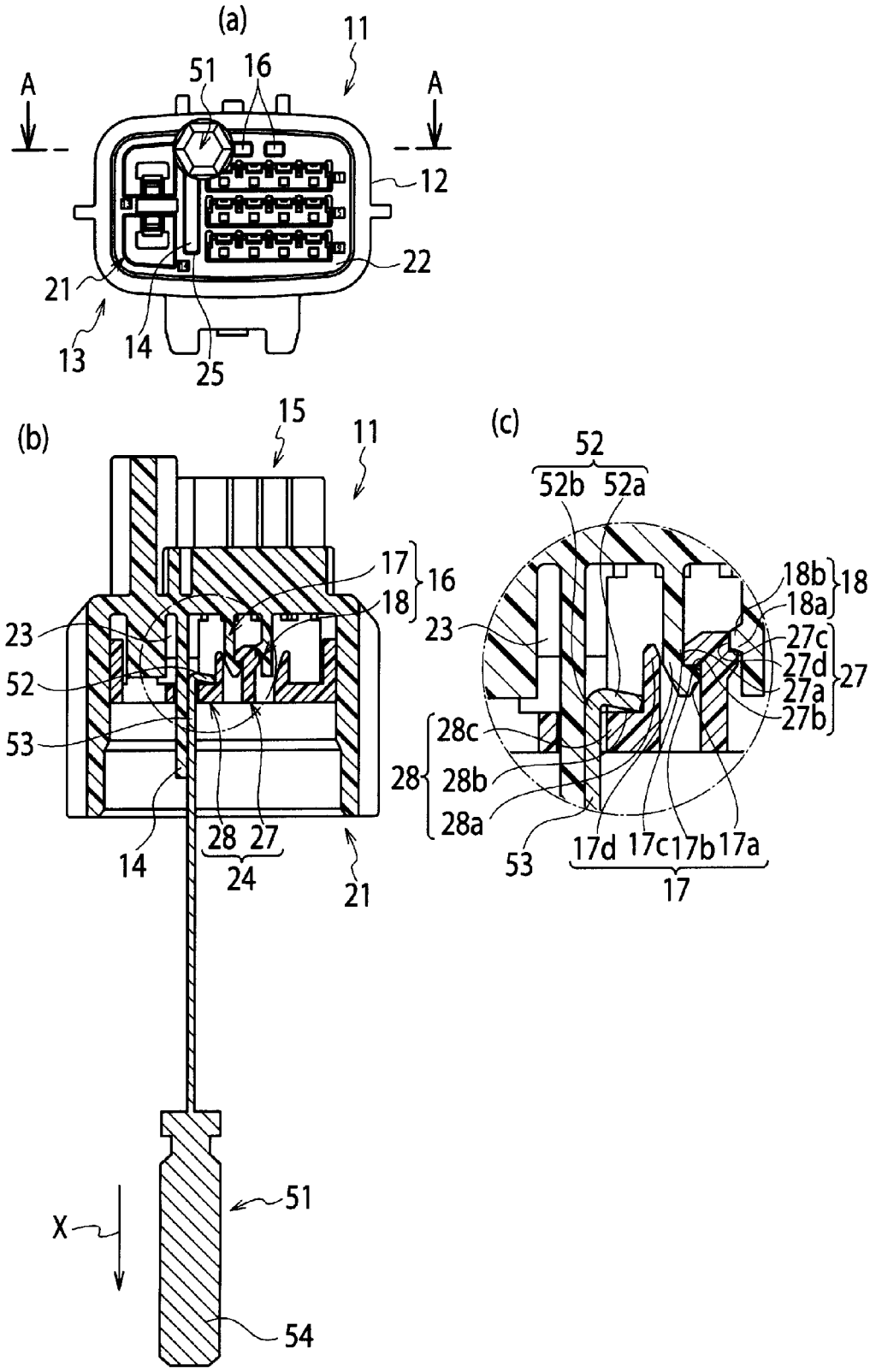
FIG. 8(*a*) is a front view illustrating a state where the jig is inserted in the connector housing and front holder of the holder lock structure according to the first embodiment of the present invention, FIG. 8(*b*) is a cross-sectional view taken along a line A-A of FIG. 8(*a*), and FIG. 8(*c*) is an enlarged view of a part indicated by a dashed-dotted line circle in FIG. 8(*b*).

Next, a description is given of locking and unlocking between the connector housing and front holder of the holder lock structure according to the first embodiment of the present invention with reference to FIGS. 6 to 8.

First, a description is given of a case of locking the front holder 21 to the connector housing 11.

As illustrated in FIGS. 6 to 8, when the front holder 21 is inserted into the connector housing 11, the second lock portion 24 of the front holder 21 is locked to the first lock portion of the connector housing 11. The front holder 21 is thus locked in the connector housing 11 at a normal locking position.

As illustrated in FIGS. 8(*b*) and 8(*c*), the first lock portion 16 of the connector housing 11 includes a holder locking hook portion 17 and a locking bump portion 18. When the front holder 21 is locked at the normal locking position in the connector housing 11, the holder locking hook portion 17 is in contact with a locking protrusion 27 and an unlocking protrusion 28 (described later) of the second locking portion 24 of the front holder 21, and the locking bump portion 18 is in contact with the locking protrusion 27.

The second locking portion 24 of the front holder 21 illustrated FIGS. 8(*b*) and 8(*c*) includes the locking protrusion 27 and unlocking protrusion 28. When the front holder 21 is locked to the connector housing 11 at the normal locking position, the locking protrusion 27 abuts on the holder locking hook portion 17 and the locking bump portion 18, and the unlocking protrusion 28 abuts on the holder locking hook portion 17. When the jig 51 is inserted into the jig insertion hole 26 in a state where the connector housing 11 is coupled to the front holder 21, a tip portion 52 of the jig 51 comes into contact with the unlocking protrusion 28.

When the front holder 21 is inserted into the connector housing 11, a hook portion inclined surface 17*a* of the holder locking hook portion 17 first comes into contact with a locking protrusion side surface 27*a* of the locking protrusion 27. When the front holder 21 is further inserted into the connector housing 11, the locking protrusion side surface 27*a* passes over the hook portion inclined surface 17*a*, and a hook portion flat surface 17*b* of the holder locking hook portion 17 comes into contact with a locking protrusion flat surface 27*b* of the locking protrusion 27. At the same time, a hook portion side surface 17*c* of the holder locking hook portion 17 comes into contact with the locking protrusion side surface 27*a*, and a hook portion protrusion 17*d* of the holder locking hook portion 17 comes into contact with or close to an unlocking protrusion side surface 28*a* of the unlocking protrusion 28.

When the front holder 21 is inserted into the connector housing 11, moreover, a bump portion flat surface 18*a* of the locking bump portion 18 comes into contact with a locking protrusion bump portion 27*c* of the locking protrusion 27, and a bump portion side surface 18*b* of the locking bump portion 18 comes into contact with a locking protrusion opposite side surface 27*d* of the locking protrusion 27. By the bump portion flat surface 18*a* of the locking bump portion 18 brought into contact with the locking protrusion bump portion 27*c* of the locking protrusion 27 in such a manner, the front holder 21 is prevented from being inserted into the terminal accommodation 15 side of the connector housing 11 (see FIG. 3). Accordingly, the front holder 21 can be locked at the normal locking position.

The holder locking hook portion 17 of the connector housing 11 may be composed of a member having a predetermined elasticity so as to bend to the rib 14 side. In other words, the holder locking hook portion 17 may be composed of a member having such a degree of elasticity that the hook portion inclined surface 17*a* can pass over the locking protrusion side surface 27*a* to bring a hook portion flat surface 17*b* of the holder locking hook portion 17 into contact with the locking protrusion flat surface 27*b* of the locking protrusion 27 (a material such as synthetic resin or the like).

The locking protrusion 27 of the front holder 21 may be composed of a member having a predetermined elasticity so as to bend toward the side opposite to the rib 14. In other words, the locking protrusion 27 may be composed of a member having such a degree of elasticity that the locking protrusion flat side surface 27*a* can pass over the hook portion inclined surface 17*a* to bring the hook portion flat surface 17*b* of the holder locking hook portion 17 into contact with the locking protrusion flat surface 27*b* of the locking protrusion 27 (a material such as synthetic resin or the like).

Next, a description is given of a case of unlocking the front holder 21 from the connector housing 11.

In order to unlock the front holder 21 from the connector housing 11, as illustrated in FIGS. 6 to 8, the tip portion 52 of the jig 51 is inserted into the jig insertion hole 26 of the front holder 21.

The jig 51 includes: the tip portion 52 to be locked to the unlocking protrusion 28; a rod portion 53 extending substantially at right angles to the tip portion 52; and a grip portion 54 gripped by a hand to insert the jig 51 into the jig insertion hole 26.

The jig insertion hole 26 of the front holder 21 is provided continuously to the rib insertion hole 25 as illustrated in FIG. 6. To be specific, the rib insertion hole 25 is linearly extended from the lower end 25*a* (the lower side of the front holder 21) to the upper end 25*b* (the upper side of the front holder 21). The jig insertion hole 26 is provided substantially at right angles to the rib insertion hole 25. The jig insertion hole 26 includes the right end 26*b* which is extended from the left end 26*a* continuous to the connecting portion 29 toward the center of the front holder 21.

The jig 51 is inserted into the jig insertion hole 26 with the tip portion 52 of the jig 51 (the tip of a top flat portion 52*a* described later) being directed to the center of the front holder 21. The jig 51 can be therefore easily inserted into the jig insertion hole 26. This can prevent the tip portion 52 of the jig 51 from damaging the front holder 21, the terminal fittings 41 accommodated in the terminal accommodation 15 of the connector housing 11, and the like. Moreover, the jig 51 can be easily guided to the unlocking position by the jig insertion hole 26 (see FIG. 8(*b*)).

As illustrated in FIG. 8(*b*), the jig 51 is inserted to the unlocking position. As the unlocking protrusion 28 provided near the locking protrusion 27 of the front holder 21 has an unlocking protrusion flat surface 28*b* as illustrated in FIG. 8(*c*), the tip flat portion 52*a* of the tip portion 52 of the jig 51 comes into contact with the unlocking flat surface 28*b*. At the same time, the tip side portion 52*b* of the tip portion 52 comes into contact with or close to an unlocking side portion 28*c* to lock the jig 51 at the unlocking position.

When the jig 51 is locked at the unlocking position, the rod portion 53 of the jig 51 is in contact with the rib 14. The rib 14 protrudes in parallel to a direction of an arrow X illustrated in FIGS. 6 to 8. Accordingly, if the grip portion 54 is pulled in the direction of the arrow X with the jig 51 being in contact with the rib 14, the front holder 21 formed in the connector housing 11 can be unlocked.

As described above, when the jig 51 is locked at the unlocking position, the rod portion 53 of the jig 51 is in contact with the rib 14. Accordingly, when the grip portion 54 of the jig 51 is pulled in the direction of the arrow X illustrated in FIGS. 6 to 8, the jig 51 can be pulled perpendicularly to the surface of the front holder 21. It is therefore possible to prevent the front holder 21, terminal fittings 41, and the like from being broken or damaged by the jig 51 which separates from the unlocking position when pulled or is pulled at a predetermined angle to the surface of the front holder 21 (in a direction other than the direction of the arrow X illustrated in FIGS. 6 to 8).

Moreover, as illustrated in FIG. 8(*b*), the jig insertion hole 26 is provided near the second locking portion 24. Accordingly, the distance between the second locking portion 24 and the jig insertion hole 26 (unlocking protrusion 28) can be short. Compared to the case where the second locking portion 24 is distant from the jig insertion hole 26 (unlocking protrusion 28), the front holder 21 locked in the connector housing 11 can be easily unlocked even if the jig 51 is pulled with small force. The unlocking workability can be thus improved.

Second Embodiment

Next, a description is given of a holder structure according to a second embodiment of the present invention with reference to FIGS. 9 to 11C.

First, a description is given of a structure of a front holder of the holder lock structure according to the second embodiment of the present invention. A front holder 61 of the holder lock structure of the second embodiment of the present invention includes a holder body 62, the terminal retaining protrusion portions 23, and the second locking portion 24. The holder body 62 is inserted into the connector housing 11. The terminal retaining protrusion portions 23 are configured to prevent the terminal fittings 41 accommodated in the terminal accommodation 15 of the connector housing 11 (see FIG. 3) from being removed (see FIG. 11(*c*)). The second locking portion 24 is locked to the first locking portion 16 of the connector housing 11 (see FIG. 11(*b*)).

Figure 9:
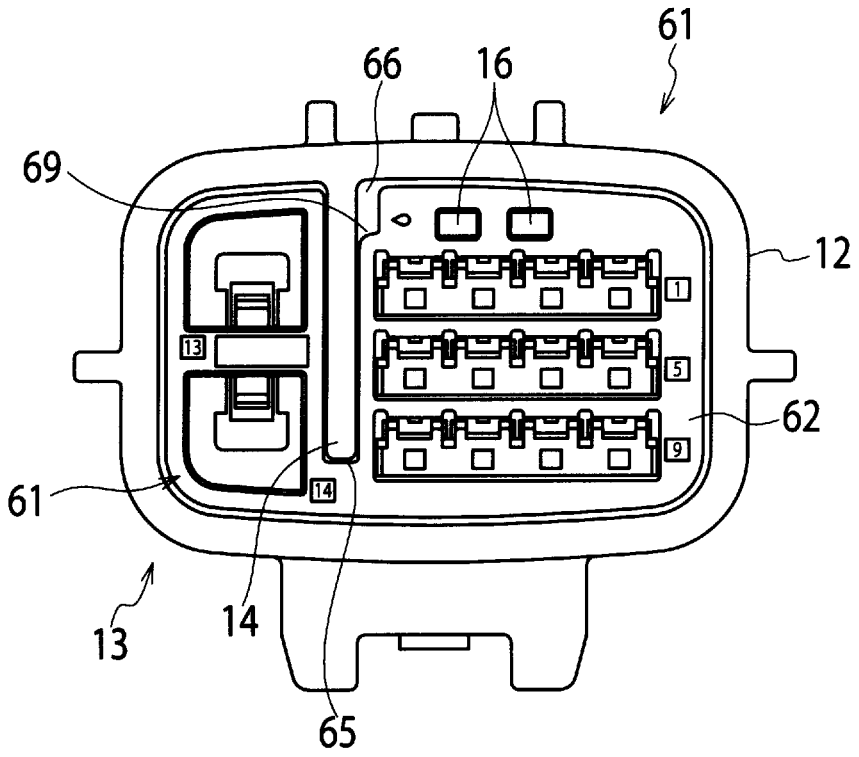
FIG. 9 is a front view of a connector housing of a holder lock structure according to a second embodiment of the present invention.
Figure 10:
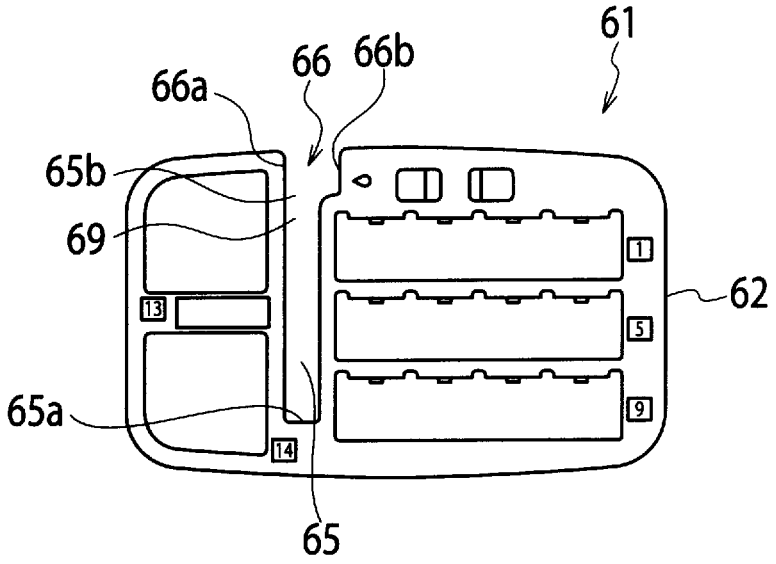
FIG. 10 is a front view of a front holder of the holder lock structure according to the second embodiment of the present invention.

As illustrated in FIGS. 9 and 10, the holder body 62 is provided with a rib insertion hole 65 and a jig insertion hole 66. The rib 14 of the connector housing 11 is inserted into the rib insertion hole 65. The jig 51 is inserted into the jig insertion hole 66 to separate the front holder 61 from the connector housing 11 (see FIG. 3).

The rib insertion hole 65 and jig insertion hole 66 are continuously provided as illustrated in FIGS. 9 and 10. The rib 14 to be inserted into the rib insertion hole 65 is provided continuously from an inner surface of the fitting hood 13 (a surface opposite to a side to which the front holder 61 is locked, see FIG. 3). The rib insertion hole 65 and the jig insertion hole 66 continuous to the rib insertion hole 65 are opened toward the inner surface of the fitting hood 13 (the surface opposite to a side to which the front holder 61 is locked).

The rib insertion hole 65 is extended linearly from a lower end 65*a* of the front holder 61 (lower side of the front holder 61) to an upper end 65*b* (upper side of the front holder 61). A connecting portion 69 connecting the rib insertion hole 65 and jig insertion hole 66 is provided on a left end 66*a* side of the jig insertion hole 66. A right end 66*b* of the jig insertion hole 66 continuous to the left end 66*a* of the jig insertion hole 66 is provided on a straight line toward the center of the front holder 61 (see FIG. 10).

The jig insertion hole 66 is connected to the front holder 61. The jig insertion hole 66 is opened at the top of the front holder 61 from the left end 66*a* to the right end 66*b*. The rib insertion hole 65 and jig insertion hole 66 constitute a slit integrally formed with lateral part of the front holder 61. The connecting portion 69 connecting the rib insertion hole 65 and jig insertion hole 66 is provided on the left end 66*a* side of the jig insertion hole 66. The right end 66*b* of the jig insertion hole 66 continuous to the left end 66*a* of the jig insertion hole 66 is linearly extended toward the center of the front holder 61 (see FIG. 10).

Figure 11:
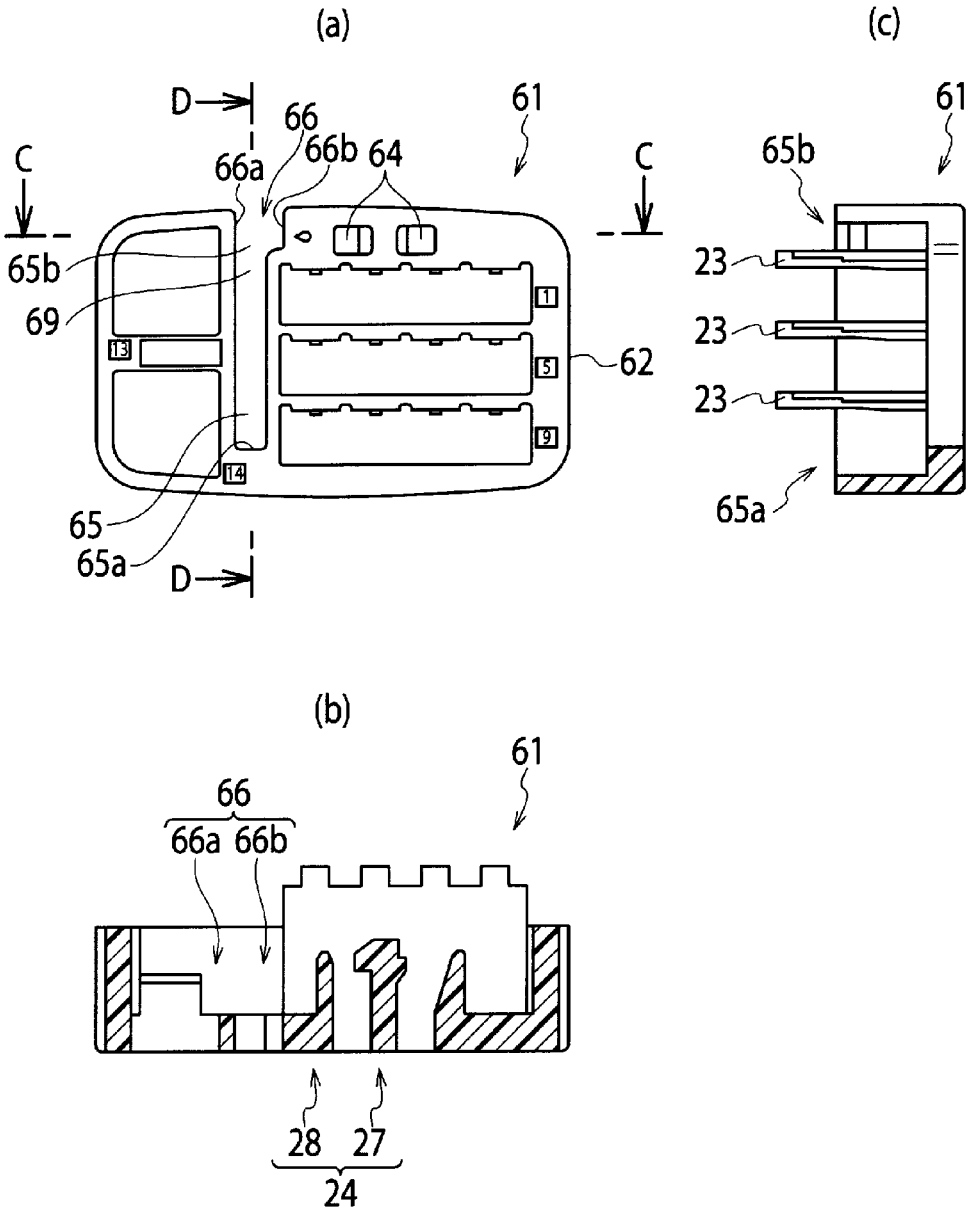
FIG. 11(*a*) is a front view of the front holder of the holder lock structure according to the second embodiment of the present invention, FIG. 11(*b*) is a cross-sectional view taken along a line C-C of FIG. 11(*a*), and FIG. 11(*c*) is a cross-sectional view taken along a line D-D of FIG. 11(*a*).

As illustrated in FIG. 11(*c*), the terminal retaining protrusion portions 23 are flexible. When the terminal fittings 41 (see FIG. 3) are inserted, the terminal retaining protrusion portions 23 bend toward the rib insertion hole 65 (the lower side of the front holder 61). This prevent the terminal fittings 41 accommodated in the terminal accommodation 15 of the connector housing 11 from being removed from the connector housing 11.

Next, a description is given of unlocking between the connector housing 11 and front holder 61 of the holder locking structure according to the second embodiment of the present invention with reference to FIGS. 11(*a*) to 11(*c*).

To unlock the front holder 61 locked to the connector housing 11, the tip portion 52 of the jig 51 (see FIG. 8(*b*)) is inserted into the jig insertion hole 66 of the front holder 61 illustrated in FIG. 11(*a*).

The jig insertion hole 66 of the front holder 61 is provided continuously to the rib insertion hole 65 as illustrated in FIG. 11(*a*). The rib insertion hole 65 is linearly extended from the lower end 65*a* (the lower side of the front holder 61) to the upper end 65*b* (the upper side of the front holder 61), and the jig insertion hole 66 is extended substantially at right angles to the rib insertion hole 65. The jig insertion hole 66 includes the right end 66*b* extending from the left end 66*a* continuous to the connecting portion 69 toward the center of the front holder 61.

The rib insertion hole 65 and jig insertion hole 66 constitute a slit integrally formed with the lateral part of the front holder 61. The connecting portion 69 connecting the rib insertion hole 65 and jig insertion hole 66 can be used as a guide to insert the jig 51.

Since the connecting portion 69 can be used as a guide when the tip portion 52 of the jig 51 is inserted into the jig insertion hole 66, the jig 51 can be easily inserted into the jig insertion hole 66. Accordingly, the tip portion 52 of the jig 51 cannot damage the front holder 61, the terminal fittings 41 accommodated in the terminal accommodation 15 of the connector housing 11, and the like. Moreover, the jig 51 can be easily guided to the unlocking position by the connecting portion 69 (see FIG. 8(*b*)).

The jig 51 is inserted into the jig insertion hole 66 to be locked at the unlocking position (see FIG. 8(*b*)), and then the gripping portion 54 of the jig 51 is pulled in the predetermined direction (in the direction of the arrow X in FIG. 8(*b*)). The front holder 61 locked to the connector housing 11 can be thus unlocked.

In such a manner, when the jig 51 is locked to the unlocking position, the rod portion 53 of the jig 51 is brought into contact with the rib 14. Accordingly, when the jig 51 is pulled in the direction of the arrow X illustrated in FIGS. 6 to 8, the jig 51 can be pulled perpendicularly to the front surface of the front holder 61. It is therefore possible to prevent the front holder 61, terminal fittings 41, and the like from being broken or damaged by the jig 51 which separates from the unlocking position when pulled or is pulled at a predetermined angle to the front surface of the front holder 61 (in the direction other than the direction of the arrow X illustrated in FIGS. 6 to 8).

As illustrated in FIGS. 11(*a*) and 11(*b*), the jig insertion hole 66 is provided near the second locking portion 24. Accordingly the distance between the jig insertion hole 66 and the second locking portion 24 (unlocking protrusion 28) can be short. Compared to the case where the jig insertion hole 66 is distant from the second locking portion 24 (unlocking protrusion 28), the front holder 61 locked to the connector housing 11 can be easily unlocked even if the jig 51 is pulled with small force. The unlocking workability can be therefore improved.

The holder locking structure of the present invention is described based on the embodiments illustrated in the drawings, but the present invention is not limited to the embodiments. The configuration of each part can be replaced with an arbitrary configuration providing a similar function.

In the above description of the holder locking structure according to the first and second embodiments of the present invention, the rib insertion holes 25 and 65 are extended linearly from the lower ends 25*a* and 65*a* (lower sides of the front holders 21 and 61) to the upper ends 25*b* and 65*b* (upper sides of the front holders 21 and 61), respectively. However, the rib insertion holes can be changed to various shapes corresponding to the shapes of the ribs.

Moreover, in the above description of the holder locking structure according to the first and second embodiments of the present invention, the connecting portions 29 and 69 are provided on the left ends 26*a* and 66*a* sides of the jig insertion holes 26 and 66, and the right ends 26*b* and 66*b* continuous to the left ends 26*a* and 66*a* are provided on the central side of the front holder 21, respectively. However, the shapes of the rib and jig insertion holes can be properly changed as long as the rib and jig insertion holes are continuously provided.

Industrial Applicability

The present invention relates to a connector housing used in connection of wire harnesses for vehicles and the like. The present invention can improve the workability at unlocking the front holder locked to the connector housing and is very useful to miniaturize the connector housing.

The invention claimed is:

1. A holder locking structure, comprising:

a connector housing including a fitting hood to which another connector is inserted and fit, a terminal accommodation accommodating a terminal fitting, and a rib which is protruded into the fitting hood and is configured to prevent terminal connection fault of the terminal fitting; and a front holder which is inserted in the fitting hood of the connector housing and is locked to the connector housing to prevent removal of the terminal fitting, the front holder provided with a rib insertion hole to which the rib is inserted, wherein the connector housing includes a first locking portion for locking the front holder to the connector housing, the front holder is provided with a jig insertion hole into which a jig can be inserted to unlock the front holder from the connector housing, and the rib insertion hole and the jig insertion hole are continuously provided.

2. The holder locking structure of claim 1, wherein the rib is provided so as to be continuous from an inner surface of the fitting hood, and the rib insertion hole and the jig insertion hole continuously provided for the front holder are opened toward the inner surface of the fitting hood.

3. The holder locking structure of claim 1, wherein the connector housing includes a connector body provided with the terminal accommodation and the first locking portion, the fitting hood is integrally formed with the connector body, a contact portion of the terminal fitting accommodated in the terminal accommodation is protruded in the fitting hood, the rib is integrally formed with the connector body and is protruded in the fitting hood to prevent terminal connection fault of the terminal fitting protruding in the fitting hood, and the front holder includes a holder body in which a insertion hole to which the rib is inserted and the jig insertion hole are formed, a terminal retaining protrusion portion for preventing the terminal fitting accommodated in the terminal accommodation of the connector housing from being removed, and a second locking portion locked to the first locking portion of the connector housing.

* * * * *